US010597967B2

(12) United States Patent
Smith et al.

(10) Patent No.: US 10,597,967 B2
(45) Date of Patent: Mar. 24, 2020

(54) SYSTEM AND METHOD FOR REMOTELY COUPLING WIRELINE SYSTEM TO WELL

(71) Applicant: Halliburton Energy Services, Inc., Houston, TX (US)

(72) Inventors: David William Smith, Richmond, TX (US); Jonathan Marshall Deshler, Houston, TX (US); Stephen Robert Ingram, Katy, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 179 days.

(21) Appl. No.: 15/754,352

(22) PCT Filed: Apr. 5, 2017

(86) PCT No.: PCT/US2017/026168
§ 371 (c)(1),
(2) Date: Feb. 22, 2018

(87) PCT Pub. No.: WO2018/186857
PCT Pub. Date: Oct. 11, 2018

(65) Prior Publication Data
US 2019/0032439 A1 Jan. 31, 2019

(51) Int. Cl.
*E21B 33/072* (2006.01)
*E21B 33/038* (2006.01)
*E21B 19/00* (2006.01)

(52) U.S. Cl.
CPC ..... *E21B 33/072* (2013.01); *E21B 19/008* (2013.01); *E21B 33/038* (2013.01)

(58) Field of Classification Search
CPC ..... E21B 19/008; E21B 33/038; E21B 33/03885; E21B 33/076; E21B 33/072
See application file for complete search history.

(56) References Cited

U.S. PATENT DOCUMENTS 4,673,041 A 6/1987 Turner et al.
4,886,115 A * 12/1989 Leggett ..... E21B 29/04 166/77.1
8,550,169 B2 * 10/2013 McKay ..... E21B 17/085 166/343
2002/0139535 A1 10/2002 Nice et al.
2005/0189115 A1 * 9/2005 Rytlewski ..... B63G 8/001 166/344
2008/0264643 A1 10/2008 Skeels et al.
(Continued)

FOREIGN PATENT DOCUMENTS

WO 2004003338 A1 1/2004

OTHER PUBLICATIONS

International Search Report and Written Opinion dated Dec. 8, 2017; International PCT Application No. PCT/US2017/026168.

*Primary Examiner* — Michael R Wills, III
(74) *Attorney, Agent, or Firm* — McGuireWoods, LLP

(57) ABSTRACT

The disclosed embodiments include a method for coupling a wireline system to a wellhead. The method includes storing a downhole tool within the wireline system. The method also includes coupling the wireline system to the wellhead via a remotely actuated connector and pressure testing the wireline system. Further, the method includes opening a valve of the wellhead to enable passage of the downhole tool from the wireline system to a well.

18 Claims, 4 Drawing Sheets

(56) References Cited

U.S. PATENT DOCUMENTS

| | | | | |
|---|---|---|---|---|
| 2013/0048309 | A1* | 2/2013 | Young | E21B 23/00 166/379 |
| 2013/0206419 | A1* | 8/2013 | Hallundbaek | E21B 33/06 166/341 |
| 2016/0245035 | A1* | 8/2016 | Brady | E21B 43/116 |
| 2018/0209236 | A1* | 7/2018 | Talgo | E21B 33/072 |

* cited by examiner

SYSTEM AND METHOD FOR REMOTELY COUPLING WIRELINE SYSTEM TO WELL

BACKGROUND

The present disclosure relates generally to wireline operations at a well, and more specifically to providing remote coupling and decoupling of wireline systems to wellheads of the well during a wireline operation.

While preparing and operating a drilling pad that includes several wells in close proximity, certain operations on or in a well at the drilling pad prevent workers from being within a specified range of the well undergoing the operation. For example, when a pumping service company has created a high pressure zone around one well during a hydraulic fracturing operation, personnel may not be allowed to enter the high pressure zone that includes other wells on a multi-well drilling pad. In such a situation, a wireline service company crew may be forced to wait to manually couple or decouple a wireline system from a wellhead of a separate well on the same multi-well drilling pad.

Because crews manually couple and decouple the wireline system to and from the wellheads, a significant amount of inefficiency occurs as a result of active high pressure zones at the multi-well drilling pad. As the wireline service company finishes wireline work in one well, the wireline service company crew remains offline until the high pressure zone at the multi-well drilling pad becomes inactive. Due to remaining offline, the wireline service company crew is unable to perform additional work related to providing wireline operations to additional wells at the multi-well drilling pad.

BRIEF DESCRIPTION OF THE DRAWINGS

Illustrative embodiments of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components in the embodiments and figures described below are merely illustrative and do not imply that any particular step or component is a requirement of a claimed embodiment.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The present disclosure relates to coupling wireline systems to wellheads of drilled wells. More particularly, the present disclosure relates to remotely coupling the wireline systems to the wellheads on multi-well drilling pads. The presently disclosed embodiments may be used in horizontal, vertical, deviated, or otherwise nonlinear wells in any type of subterranean formation. Embodiments may include coupling the wireline systems to the wellheads using hydraulically actuated couplings, electrically actuated couplings, or any other coupling capable of remote actuation.

Figure 1:
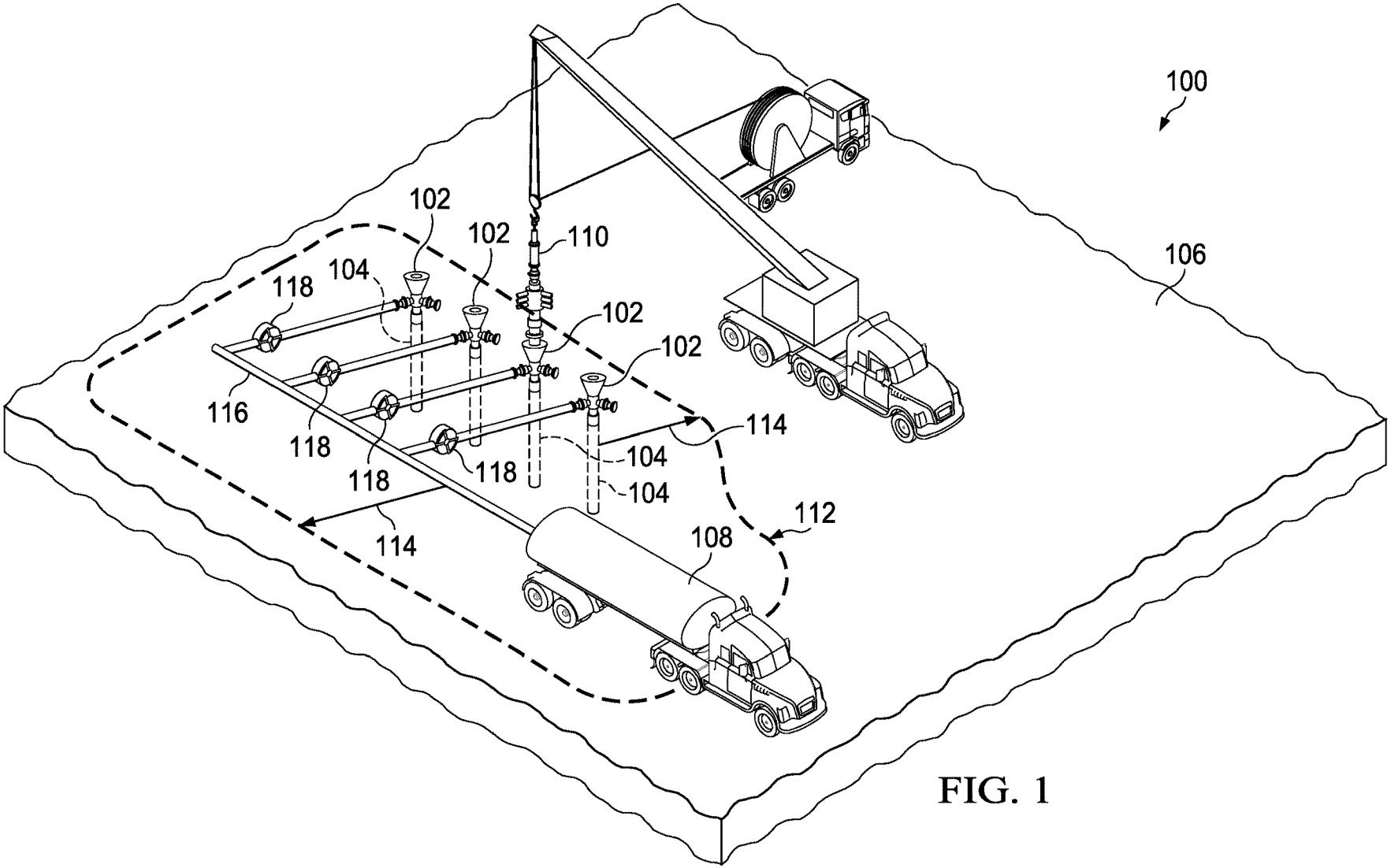
FIG. 1 is a perspective view of a multi-well drilling pad, including a plurality of wellheads.

Referring to FIG. 1, a perspective view of a multi-well drilling pad 100, including a plurality of wellheads 102 affixed atop a plurality of wells 104, is illustrated. The multi-well drilling pad 100 includes the wells 104 in close proximity. The number of wells 104 provided on the multi-well drilling pad 100 improves oil and gas production in a limited geographic area occupied by the multi-well drilling pad 100 in comparison to traditional well pads with individual wells.

The wells 104 are drilled through a crust layer 106 of earth to an oil and gas pay zone, which resides between the crust layer 106 and a sub-surface impervious rock layer. The wells 104 may include lateral wells, multi-lateral wells, or vertical wells depending on a type and location of the oil and gas pay zone. Because multiple wells 104 are positioned within the multi-well drilling pad 100, the multi-well drilling pad 100 covers a relatively small surface area compared to a much larger expanse of the pay zone beneath the crust layer 106 that the wells 104 are able to reach.

Completions work for the multi-well drilling pad 100 may be performed in multiple stages. For example, a fracturing pump unit 108 treats one of the wells 104 while a wireline system 110 performs wireline activities on another of the wells 104. When the fracturing pump unit 108 creates a high pressure zone 112 at one of the wellheads 102, the remaining wellheads 102 of the wells 104 that are within the high pressure zone must be free of workers. As used herein, the high pressure zone 112 is a radius 114 around a wellhead 102 and frac iron 116 of one of the wells 104 when the well 104 is undergoing pressure treatment. The radius 114 of the high pressure zone 112 may be a radius of approximately 15 feet surrounding the wellhead 102 of the well 104 under pressure and any of the frac iron 116 that is also under pressure.

When downhole wireline activities performed by the wireline system 110 are completed, or when a wireline system 110 is prepared to couple to a new wellhead 102, a wireline service company may remotely remove the wireline system 110 from the wellhead 102 or remotely couple the wireline system 110 to the wellhead 102. In this manner, the pumping service company is able to continuously perform pumping operations on a wellhead 102 while the wireline service company transitions the wireline system 110 between the wellheads 102 because the wireline system 110 is remotely coupled to or removed from the wellheads 102 by personnel positioned outside of the high pressure zone 112. While the wireline system 110 is remotely coupled to or removed from the wellheads 102, the pumping service company is also able to remotely transition pumping operations from one wellhead 102 to another wellhead 102 without waiting for the wireline service company to clear personnel from the multi-well drilling pad 100. The pumping service company transitions the pumping operations between the wellheads 102 by opening and closing valves 118 that control application of fracturing fluid to the wells 104. In this manner, downtime of crews of the wireline service company or the pumping service company is avoided. As used herein, the terms remotely couple and remotely remove refer to coupling and removing the wireline system 110 to and from the wellhead 102 while members of the wireline service company are outside of the active high pressure zone 112 of a neighboring well 104.

In another embodiment, each of the wellheads 102 may be separated from a reach of the high pressure zone 112 of a neighboring wellhead 102. However, securing the wireline assembly 110 to the wellheads 102 remotely still provides increased efficiency and reliability over manually coupling the wireline assembly 110 to the wellheads 102. For example, in an embodiment, the wireline assembly 110 is coupled to the wellheads 102 using a hydraulically actuated coupling, as discussed in detail below with reference to FIG. 3. The hydraulically actuated coupling provides a quicker coupling mechanism that is reliably repeated when compared to a manual coupling that is more labor intensive and not as precise. Additionally, during a pumping operation of the individual wellhead 102, the wireline system 110 may be coupled to the individual wellhead 102. Because the wireline system 110 is readied for deployment while the pumping operation is occurring, there is little downtime between the pumping operation and the wireline operation. Further, as soon as the wireline operation is completed by the wireline system 110, a new pumping operation may commence as the wireline system 110 is removable from the wellhead 102 from a remote location. Accordingly, the remote coupling of the wireline assembly to the wellheads 102 provides efficiency advantages even when the wellheads 102 are not within a high pressure zone of a neighboring wellhead 102.

Figure 2:
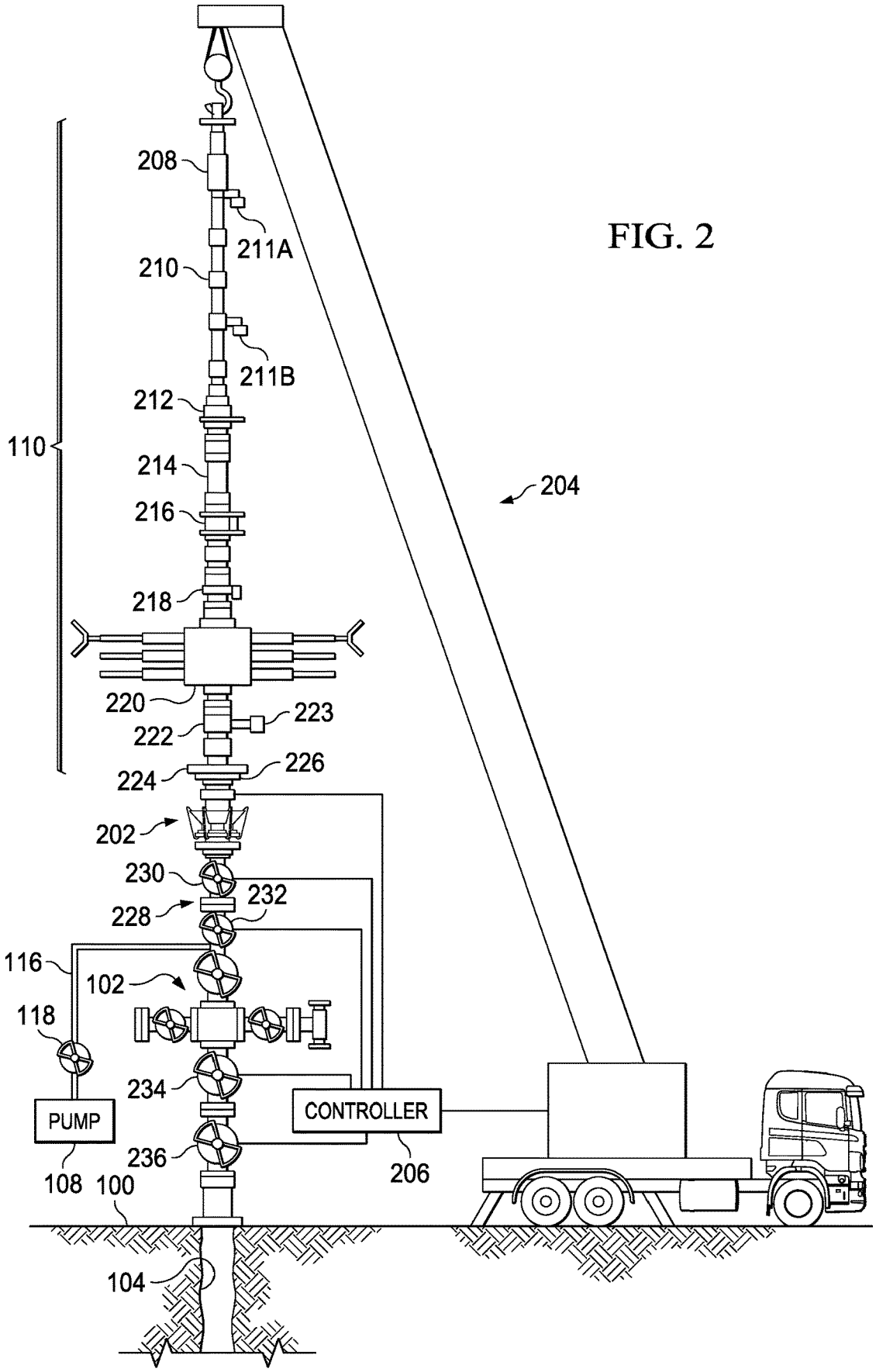
FIG. 2 is a schematic view of a wireline system coupled to a wellhead.

Turning now to FIG. 2, a schematic view of a wireline system 110 coupled to a wellhead 102 is illustrated. The wireline system 110 is coupled to the wellhead 102 via a remotely actuated connector 202, which is discussed in greater detail with reference to FIG. 3. Prior to beginning a wireline operation, any downhole tools (e.g., a bottom hole assembly (BHA)) used during a wireline operation are loaded into the wireline system 110. Upon loading the downhole tools into the wireline system 110, a crane 204 lifts the wireline system 110 for placement above the wellhead 102. In an embodiment, movement of the crane 204 is controlled remotely via a controller 206 to remove personnel from the proximity of the wellhead 102, which may be within a high pressure zone of a neighboring wellhead 102, as discussed above with respect to FIG. 1.

The controller 206, in an embodiment, also provides remote control to actuate the remotely actuated connector 202. The controller 206 may be a single controller, or the controller 206 may include multiple controllers that each control individual components of the wireline system 110 and the crane 204. In this manner, wireline personnel are able to perform coupling and decoupling procedures of the wireline system 110 from a remote location. As discussed above with reference to FIG. 1, performing the coupling and decoupling procedures remotely reduces downtime of the wireline personnel when access to the wellhead 102 is restricted. Further, the controller 206 is located outside of the active high pressure zone 112 of a neighboring well 104 to remove the wireline personnel from the active high pressure zone 112 of the neighboring well 104.

The wireline system 110, includes a wireline stuffing box 208. The wireline stuffing box 208 packs-off around a wireline cable if a grease seal is lost. Additionally, the wireline stuffing box 208 may include a wireline wiper that wipes the wireline cable clean of excess grease when the wireline cable is removed from the well 104.

Coupled to the wireline stuff box 208 is a grease injection head 210. The grease injection head 210 controls and contains well pressure while preventing wellbore fluids and gases from escaping the well 104. During operation, grease is pumped into the grease injection head 210 from a grease injection system to a grease valve 211A, and grease is removed from the grease injection head 210 and returned to the grease injection system via a grease valve 211B. Pumping the grease through the grease injection head 210 creates a reliable seal between the wireline cable and an interior of the grease injection head 210.

Positioned beneath the grease injection head 210 is a head catcher 212. The head catcher 212, when included in the wireline system 110, provides a mechanism that catches and holds the downhole tool coupled to the wireline cable during pressure testing prior to deploying the downhole tool into the well 104. Additionally, the head catcher 212 is used in the event of the wireline cable being inadvertently pulled off at the surface upon removal of the downhole tool from the well 104 to prevent a fishing operation to retrieve the pulled off downhole tool from the well 104.

The wireline system 110 also includes a lubricator riser 214. The lubricator riser 214, which may include multiple lubricator risers 214 depending on a length of the downhole tool, is used in the wireline system 110 to store the downhole tool above the well 104 prior to deployment downhole in the well 104. Additionally, the lubricator riser 214 is used upon retrieval of the downhole tool from the well 104 to store the downhole tool when the wireline system 110 is removed from the wellhead 102.

A bottom section of the lubricator riser 214 may, as in the illustrated embodiment, couple to a tool trap 216. The tool trap 216 protects the well 104 from an inadvertent downhole tool pull-off from the wireline cable prior to deployment of the downhole tool into the well 104. The tool trap 216 may include a cover that is hydraulically actuated. The cover of the tool trap 216 remains closed while the wireline assembly 200 is positioned over the wellhead, and the cover is actuated into an open position when the downhole tool is ready for deployment into the well 104. Further, upon retrieving the downhole tool from the well 104, the tool trap 216 is actuated closed to prevent the downhole tool from dropping into the well 104 when the wireline system 110 is prepared for removal from the wellhead 102. Actuation of the tool trap 216 may occur remotely using the controller 206 to limit personnel physically present at the drilling pad 100.

Also included in the wireline system 110 is a quick test sub 218. The quick test sub 218 is used to pressure test pressure control equipment of the wireline system 110 when multiple wireline runs are used. For example, after performing a pressure test to determine the pressure integrity of the wireline system 110, subsequent pressure tests are performed by the quick test sub 218 to verify integrity of a valve that is opened when inserting or retrieving the downhole tool from the well 104.

A blowout preventer (BOP) 220 is positioned beneath the quick test sub 218. The BOP 220 is a valve used to seal, control, and monitor the well 104 to prevent a blowout during a wireline operation. The BOP 220, during a wireline operation, is able to cope with erratic pressures that are provided from the well 104 onto the wireline system 110. By coping with the erratic pressures, the BOP 220 may prevent the downhole tools on the wireline cable from being blown out of the well 104 during a high pressure event.

The wireline system 220 also includes a pump-in sub 222. The pump-in sub 222 allows an introduction of a high volume of fluids into the well 104. For example, the pump-in sub 222 includes a side connection 223 that couples to a fluid source for pumping fluid into the well 104. Additionally, the side connection 223 enables fluid sampling from the well 104 during a wireline operation.

A wellhead adapter flange 224 couples to a bottom portion of the pump-in sub 222. The wellhead adapter flange 224 may couple directly to the wellhead 102, or, as in the illustrated embodiment, the wellhead adapter flange 224 couples to an upper portion 226 of the remotely actuated connector 202. As discussed above, the remotely actuated connector 202 enables remote coupling or decoupling of the wireline system 110 to or from the wellhead 102.

Because the remotely actuated connector 202 is positioned above the frac iron 116 coupled to the wellhead 102, an isolation block 228, including isolation valves 230 and 232, is positioned above the wellhead 102 in place of a wellhead tree cap (not shown). The isolation valves 230 and 232 allow the wireline system 110 to couple to the wellhead 102 during a fracturing operation such that there is limited downtime during transition from a fracturing operation to a wireline operation. Because a fracturing operation at a neighboring wellhead 102 may occur immediately upon closing the valve 118 to the fracturing pump unit 108, to avoid personnel in the high pressure zone 112 of the neighboring wellhead 102, the isolation valves 230 and 232 may be remotely actuated by the controller 206. Similarly, isolation valves 234 and 236, which are located on the wellhead 102 between the frac iron 116 and the well 104, may also be remotely actuated by the controller 206 to remove the presence of personnel from the high pressure zone 112 of the neighboring wellhead 102.

Figure 3:
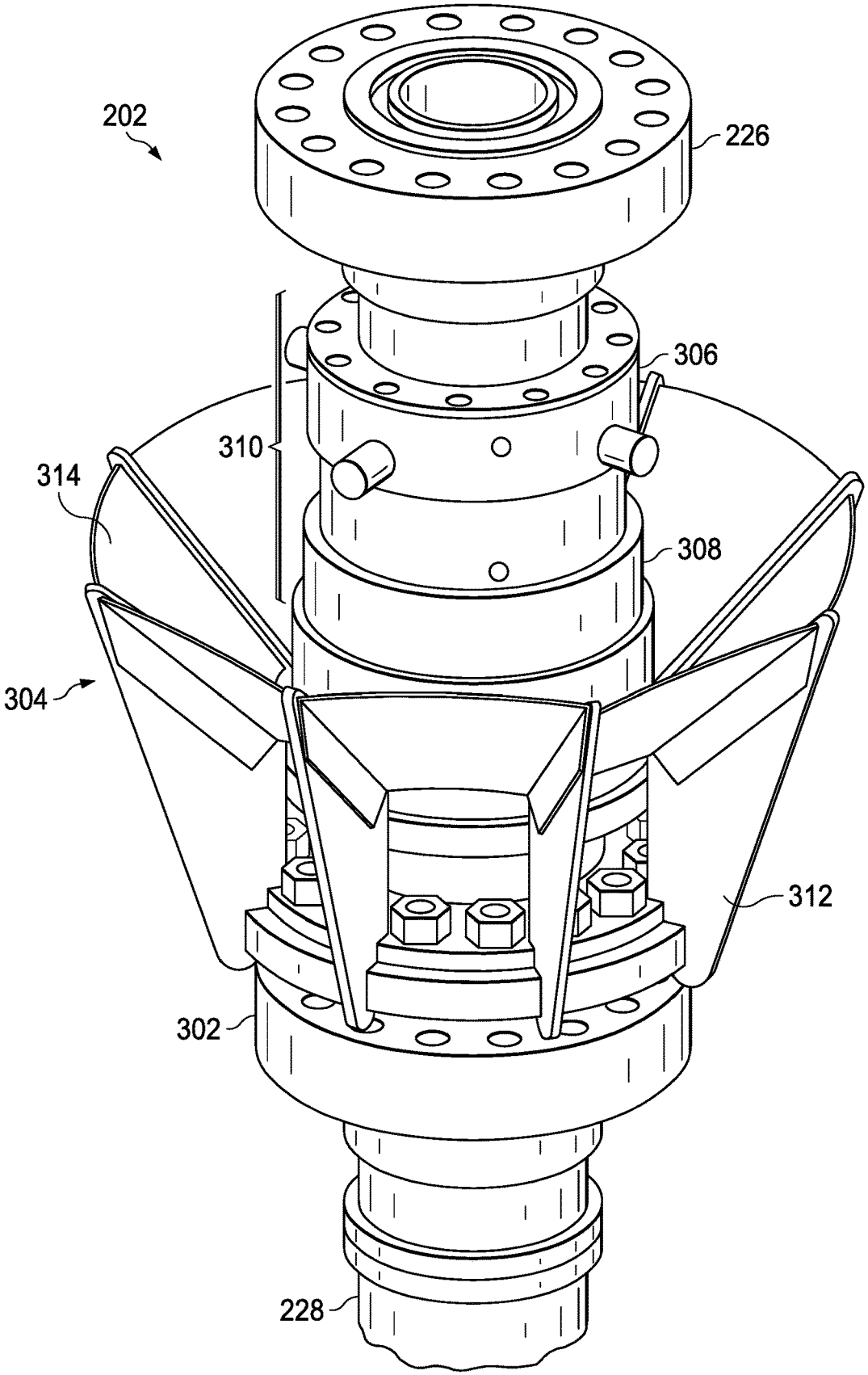
FIG. 3 is a remotely actuated connector to couple the wireline system to the wellhead of FIG. 2.

FIG. 3 illustrates a detailed view of the remotely actuated connector 202 that couples the wireline system 110 to the wellhead 102 or the isolation block 228. The upper portion 226 of the remotely actuated connector 202 couples to the wellhead adapter flange 224 of the wireline system 110. The remotely actuated connector 202 also couples directly to an upper portion 302 of the isolation block 228 or the wellhead 102 to couple the remotely actuated connector 202 to the wellhead 102. A connecting force between the remotely actuated connector 202 and the wellhead 102 is provided by the remotely actuated connector 202 to maintain the wireline system 110 and the wellhead 102 in a coupled state during a wireline operation When the upper portion 302 of the wellhead 102 is coupled to the remotely actuated connector 202, an entry guide 304 is coupled to the wellhead 102. The entry guide 304 enables an actuator 306 and a slip housing 308 to align with the upper portion 302 of the wellhead 102 when the wireline system 110 is positioned above the wellhead 102 by the crane 204. That is, the entry guide 304 guides the remotely actuated connector 202 into a connecting position with the wellhead 102. In this manner, the entry guide 304 enables the wireline system 110 to align with the wellhead 102 while personnel from the wireline service company are positioned remote from the wellhead 102, which may be within the high pressure zone 112 of a neighboring wellhead 102. While the entry guide 304 is depicted in FIG. 3 as being coupled to the upper portion 302 of the wellhead 102 or the isolation block 228, in an embodiment, the entry guide 304 may be coupled to a bottom portion 312 of the remotely actuated connector 202 and positioned with an open portion 314 facing toward the wellhead 102.

The actuator 306 is controlled via the controller 206. The controller 206 may control application of a hydraulic signal to the actuator 306 that results in the actuation of a connector 310, which includes the actuator 306 and the slip housing 308. Actuation of the connector 310 actuates slips within the slip housing 308 to securely couple the wireline system 110 to the wellhead 102. The slips within the slip housing 308 generate friction between the wireline system 110 and the wellhead 102 that is sufficient to maintain a connection between the wireline system 110 and the wellhead 102. While the remotely actuated connector 202 is described above as a slip connector, it may be appreciated that any other remotely actuated device capable of remotely coupling the wireline system 110 to the wellhead 102 or the isolation block 228 is also contemplated within the scope of the present disclosure.

The actuator 306 may be controlled using a hydraulic signal when the actuator 306 is a hydraulic actuator, however, in other embodiments, the actuator 306 may be actuated via an electrical signal, some form of a mechanical signal, or any other signal capable of providing an actuation signal to the actuator 306. Additionally, while a hydraulic actuator may provide both the signal and the actuating force via a hydraulic line to actuate the actuator 306, other technologies may be used to provide the actuating force of the actuator 306. For example, in an embodiment where the actuator 306 is actuated based on receipt of an electrical signal, a separate, local power source may provide the actuating power to actuate the slips within the slip housing 308. In another embodiment, the electrical signal applied to the actuator 306 may also be sufficient to provide the actuating power to actuate the slips within the slip housing 308.

Figure 4:
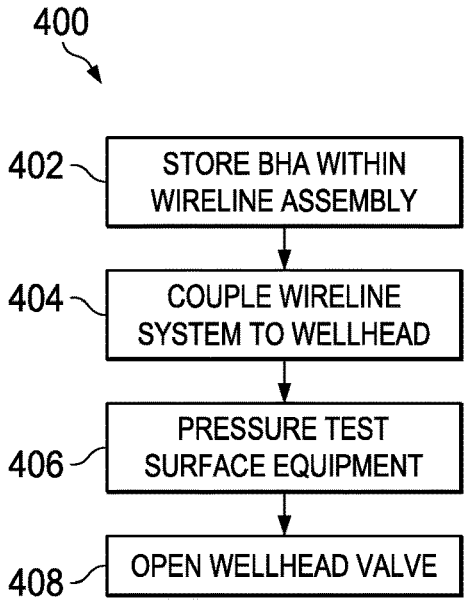
FIG. 4 is a flow chart of a method for remotely coupling the wireline system of FIG. 2 to the wellhead of FIG. 2.

Turning to FIG. 4, a flow chart of a method 400 for remotely coupling the wireline system 110 to the wellhead 102 is illustrated. Initially, at block 402, a bottom hole assembly is stored within the wireline assembly 200. As discussed above with reference to FIG. 2, the bottom hole assembly is coupled to a wireline cable, and the bottom hole assembly is stored within the lubricator riser 214 while the wireline system 110 is positioned above the wellhead 102. The bottom hole assembly may include logging tools, explosive tool assemblies (e.g., a casing perforator), or any other downhole tools that may operate using the wireline system 110.

At block 404, the wireline system 110 is coupled to the wellhead 200 using the remotely actuated connector 202. During block 404, the crane 204 lifts the wireline system 110 from a location where the bottom hole assembly is loaded into the wireline system 110, and the crane 204 transports the wireline system 110 to the wellhead 102. Control of the crane 204 may be accomplished remotely via the controller 206 to reduce presence of personnel at a site of the wellhead 102.

When the bottom hole assembly includes an explosive tool assembly, a radio frequency (RF) safe detonator may be implemented to detonate explosive charges of the explosive tool assembly. Using the RF safe detonator may increase productivity at the multi-well drilling pad 100, for example, by allowing a pumping service company performing a fracturing operation at a neighboring well 104 to maintain radio communication when the wireline service company is deploying or recovering an explosive tool assembly at the wellhead 102. The RF safe detonator minimizes downtime of other operations that are performed near an explosive tool assembly of the wireline system 110.

Subsequently, at block 406, surface equipment, including the wireline system 110, is pressure tested. Any connections of the wireline system 110 that are closed for the pressure testing are closed remotely to avoid personnel presence near pressurized lines. The pressure testing of the wireline system 110 provides an indication of whether the components of the wireline system 110 are able to prevent pressure leaks.

Once the pressure testing confirms that the wireline system 110 is operating properly, at block 408, pressure within the well 104 is equalized with the pressure in the wireline system 110, and a valve of the wellhead 102 is opened for the bottom hole assembly to enter the well 104. To accomplish pressure equalization, the wireline system 110 is isolated from atmospheric pressure, and pressure within the wireline system 110 is brought to a pressure slightly greater than pressure at the wellhead 102. At this point, the valve isolating the wellhead 102 from the wireline system 110 is opened to commence the wireline operations.

Figure 5:
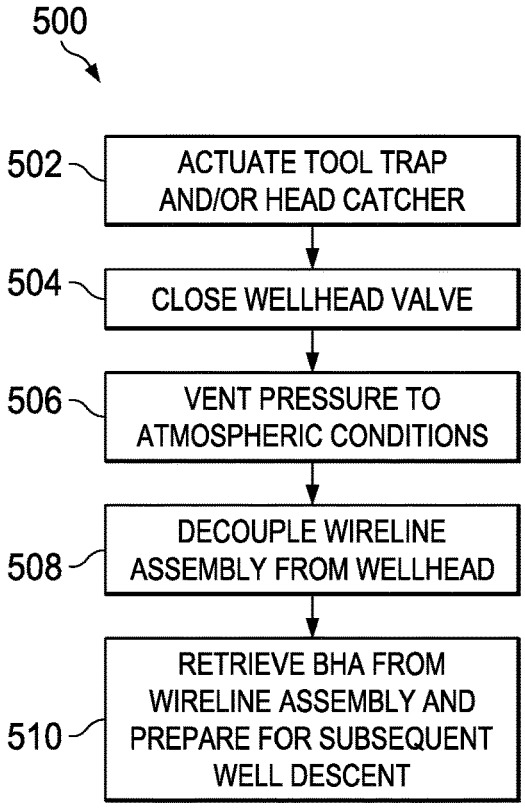
FIG. 5 is a flow chart of a method for remotely decoupling the wireline system of FIG. 2 from the wellhead of FIG. 2.

FIG. 5 is a flow chart of a method 500 for remotely decoupling the wireline system 110 from the wellhead 102. Initially, at block 502, the tool trap 216 and the head catcher 212 are actuated if either or both of the tool trap 216 or the head catcher 212 are included in the wireline system 110. The head catcher 212 is actuated into a catch position as the downhole tool is retrieved from the well 104. With the head catcher 212 in the catch position, the head catcher 212 provides a mechanism that catches and holds the downhole tool coupled to the wireline cable as the downhole tool is retrieved from the well the well 104. In this manner, the head catcher 212 is able to prevent the downhole tool from falling back into the well 104 should the wireline cable be inadvertently pulled off of the downhole tool during a retrieval operation.

Similarly, when the downhole tool is removed from the well 104 and positioned within the lubricator riser 214, the tool trap 216 is closed to prevent the downhole tool from falling into the well 104 should the wireline cable be pulled off of the downhole tool during the retrieval operation. In some embodiments, either the tool trap 216 or the head catcher 212, but not both, is provided as a part of the wireline system 110, as the tool trap 216 and the head catcher 212 generally provide overlapping functionality. In another embodiment, both the tool trap 216 and the head catcher 212 are provided as a part of the wireline system 110 to provide system redundancy should one of the tool trap 216 or the head catcher 212 not function properly during the retrieval operation.

At block 504, a valve coupling the wireline system 110 to the wellhead 102 is closed. Closing the valve of the wellhead 102 is accomplished remotely by the controller 206 when the valve is hydraulically or electrically actuated. By closing the valve of the wellhead 102, pressure below the wellhead 102 is isolated from the wellhead 102 and prevented from escaping from the well 104 when the wireline system 110 is removed from the wellhead 102.

Subsequently, at block 506, the pressure of the wireline system 110 is vented to atmospheric conditions. Venting the pressure of the wireline system 110 may be accomplished by actuating the connector 310 of the remotely actuated connector 202. As discussed above with reference to FIG. 3, the remotely actuated connector 202 is actuated remotely under control of the controller 206 to avoid physical presence of wireline personnel at the wellhead 102. In another embodiment, the wireline system 110 includes a specific venting valve that is remotely actuated under control of the controller 206 to vent the wireline system 110.

When pressure is relieved from the wireline system 110, at block 508, the wirelines system 200 is removed from the wellhead 102 when the actuator 306 of the remotely actuated connector 202 actuates the connector 310 to a disconnect position. As discussed above with reference to FIGS. 2 and 3, the actuator 306 is controlled remotely by the controller 206 to avoid physical presence of wireline personnel at the wellhead 102. Accordingly, the wireline system 110 may be removed from the wellhead 102 without any personnel physically present at the wellhead 102. In this manner, nearby wellheads 102 with an established high pressure zone may continue pressure treatment while the wireline crew performs wireline operations.

At block 510, the downhole tool (e.g., a bottom hole assembly) is retrieved from the wireline system 110 and prepared for a subsequent descent down a well 104. The subsequent descent may be in the same well 104 from which the downhole tool was removed, or the subsequent descent may be at a neighboring well 104 that benefits from a wireline operation. As mentioned above, performing wireline operations with the remotely actuated connector 202 may prove particularly beneficial for simultaneous operations on wells 104 within close proximity of one another. However, the remotely actuated connector 202, and the methods 400 and 500 described above, may also provide efficiency benefits at individual well sites by providing the ability to quickly and reliably connect and disconnect the wireline system 110 from the wellhead 102.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowchart depicts a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a method for coupling a wireline system to a wellhead, comprising: storing a downhole tool within the wireline system; coupling the wireline system to the wellhead via a remotely actuated connector; pressure testing the wireline system; and opening a valve of the wellhead to enable passage of the downhole tool from the wireline system to a well.

Clause 2, method of clause 1, wherein the wellhead is within a high pressure zone of another well.

Clause 3, the method of clause 1 or 2, wherein coupling the wireline system to the wellhead comprises remotely controlling an actuator of the remotely actuated connector to actuate a slip housing of the remotely actuated connector.

Clause 4, the method of clause 3, wherein remotely controlling the actuator to actuate the slip housing comprises providing hydraulic pressure to the actuator based on instructions from a controller located outside of an active high pressure zone of a neighboring well.

Clause 5, the method of at least one of clauses 1-4, wherein the downhole tool comprises radio frequency safe detonators, and radio communication is maintained while deploying and recovering the downhole tool from the well.

Clause 6, the method of at least one of clauses 1-5, wherein coupling the wireline system to the wellhead via the remotely actuated connector comprises providing a hydraulic actuating force to the remotely actuated connector to secure the wireline system to the wellhead.

Clause 7, the method of at least one of clauses 1-6, wherein coupling the wireline system to the wellhead via the remotely actuated connector comprises providing an electrical signal to the remotely actuated connector to electrically actuate the remotely actuated connector to secure the wireline system to the wellhead.

Clause 8, the method of at least one of clauses 1-7, comprising guiding the remotely actuated connector onto the wellhead via an entry guide.

Clause 9, the method of at least one of clauses 1-8, comprising controlling movement of the wireline system to align the wireline system with the wellhead via a controller positioned outside of an active high pressure zone.

Clause 10, the method of at least one of clauses 1-9, wherein pressure testing the wireline system comprises bringing pressure within the wireline system to a pressure greater than well pressure of the well.

Clause 11, a wireline system, comprising: a downhole tool coupled to a wireline; a lubricator riser configured to store the downhole tool prior to descent of the downhole tool into a well and after retrieving the downhole tool from the well; and a remotely actuated connector positioned between the lubricator riser and a wellhead, the remotely actuated connector comprising: a slip housing; and an actuator configured to actuate the slip housing via a remotely located controller to couple the wireline system to the wellhead, wherein the remotely located controller is positioned at a location outside of an active high pressure zone in which the wellhead is positioned.

Clause 12, the wireline system of clause 11, comprising a remotely actuated tool trap.

Clause 13, the wireline system of clause 11 or 12, comprising a remotely actuated head catcher.

Clause 14, the wireline system of at least one of clause 11-13, wherein the remotely actuated connector is hydraulically actuated or electrically actuated.

Clause 15, the wireline system of at least one of clauses 11-14, comprising an entry guide coupled to the remotely actuated connector, the entry guide configured to guide the remotely actuated connector into a coupling position above the wellhead.

Clause 16, the wireline system of at least one of clauses 11-15, wherein the wellhead is positioned within fifteen feet of a second wellhead undergoing a fracturing operation.

Clause 17, a wireline assembly, comprising: a wellhead coupled to a well; a wireline system configured to facilitate descent and retrieval of downhole tools within the well; a remotely actuated connector positioned between the wireline system and the wellhead, the remotely actuated connector configured to provide a connecting force between the remotely actuated connector and the wellhead to maintain the wireline system and the wellhead in a coupled state during a wireline operation; and an entry guide configured to guide the remotely actuated connector into a connecting position with the wellhead.

Clause 18, the wireline assembly of clause 17, wherein the entry guide is coupled to the wellhead.

Clause 19, the wireline assembly of clauses 17 or 18, wherein the entry guide is coupled to the remotely actuated connector.

Clause 20, the wireline assembly of at least one of clauses 17-19, wherein the remotely actuated connector comprises: a slip housing; and an actuator configured to actuate the slip housing via a remotely located controller to couple the wireline system to the wellhead.

Clause 21, a method for removing a wireline system from a wellhead, comprising: recovering a bottom hole assembly from a well that is positioned downhole from the wellhead; closing a valve of the wellhead to isolate well pressure from the wireline system; venting wireline system pressure to atmospheric conditions; and decoupling the wireline system from the wellhead via a remotely actuated connector while the wellhead is within an active high pressure zone.

Clause 22, the method of clause 21, wherein decoupling the wireline system from the wellhead via the remotely actuated connector comprises remotely controlling an actuator of the remotely actuated connector to release a slip within a slip housing of the remotely actuated connector.

Clause 23, the method of clause 21 or 22, comprising removing the wireline system to a location outside of the active high pressure zone to prepare the wireline system for a subsequent well descent.

Clause 24, the method of at least one of clauses 21-23, wherein the active high pressure zone is established by a neighboring wellhead under a pumping operation.

Clause 25, the method of at least one of clauses 21-24, wherein the wellhead is positioned on a drilling pad within fifteen feet of a second wellhead, and wherein decoupling the wireline system from the wellhead via the remotely actuated connector occurs during a fracturing operation at the second wellhead.

While this specification provides specific details related to remotely coupling wireline systems to a wellhead, it may be appreciated that the list of components is illustrative only and is not intended to be exhaustive or limited to the forms disclosed. Other components related to the remote coupling of the wireline system to the wellhead will be apparent to those of ordinary skill in the art without departing from the scope and spirit of the disclosure. Further, the scope of the claims is intended to broadly cover the disclosed components and any such components that are apparent to those of ordinary skill in the art.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. A method for coupling a wireline system to a wellhead, comprising:

storing a downhole tool within the wireline system;

coupling the wireline system to the wellhead via a remotely actuated connector, wherein coupling the wireline system to the wellhead comprises remotely controlling an actuator of the remotely actuated connector to actuate a slip housing of the remotely actuated connector;

pressure testing the wireline system; and opening a valve of the wellhead to enable passage of the downhole tool from the wireline system to a well.

2. The method of claim 1, wherein the wellhead is within a high pressure zone of another well.

3. The method of claim 1, wherein remotely controlling the actuator to actuate the slip housing comprises providing hydraulic pressure to the actuator based on instructions from a controller located outside of an active high pressure zone of a neighboring well.

4. The method of claim 1, wherein the downhole tool comprises radio frequency safe detonators, and radio communication is maintained while deploying and recovering the downhole tool from the well.

5. The method of claim 1, wherein coupling the wireline system to the wellhead via the remotely actuated connector comprises providing a hydraulic actuating force to the remotely actuated connector to secure the wireline system to the wellhead.

6. The method of claim 1, wherein coupling the wireline system to the wellhead via the remotely actuated connector comprises providing an electrical signal to the remotely actuated connector to electrically actuate the remotely actuated connector to secure the wireline system to the wellhead.

7. The method of claim 1, comprising performing a pumping operation at the wellhead while the wireline system is coupled to the wellhead.

8. The method of claim 1, comprising controlling movement of the wireline system to align the wireline system with the wellhead via a controller positioned outside of an active high pressure zone.

9. The method of claim 1, wherein pressure testing the wireline system comprises bringing pressure within the wireline system to a pressure greater than well pressure of the well.

10. A wireline system, comprising:

a downhole tool coupled to a wireline;

a lubricator riser configured to store the downhole tool prior to descent of the downhole tool into a well and after retrieving the downhole tool from the well; and a remotely actuated connector positioned between the lubricator riser and a wellhead, the remotely actuated connector comprising:

a slip housing; and an actuator configured to actuate the slip housing via a remotely located controller to couple the wireline system to the wellhead, wherein the remotely located controller is positioned at a location outside of an active high pressure zone in which the wellhead is positioned.

11. The wireline system of claim 10, comprising a remotely actuated tool trap and a remotely actuated head catcher.

12. The wireline system of claim 10, wherein the remotely actuated connector is hydraulically actuated or electrically actuated.

13. The wireline system of claim 10, comprising an entry guide coupled to the remotely actuated connector, the entry guide configured to guide the remotely actuated connector into a coupling position above the wellhead.

14. The wireline system of claim 10, wherein the wellhead is positioned within fifteen feet of a second wellhead undergoing a fracturing operation.

15. A method for removing a wireline system from a wellhead, comprising:

recovering a bottom hole assembly from a well that is positioned downhole from the wellhead;

closing a valve of the wellhead to isolate well pressure from the wireline system;

venting wireline system pressure to atmospheric conditions; and decoupling the wireline system from the wellhead via a remotely actuated connector while the wellhead is within an active high pressure zone, wherein decoupling the wireline system from the wellhead via the remotely actuated connector comprises remotely controlling an actuator of the remotely actuated connector to release a slip of a slip housing of the remotely actuated connector.

16. The method of claim 15, comprising removing the wireline system to a location outside of the active high pressure zone to prepare the wireline system for a subsequent well descent.

17. The method of claim 15, wherein the active high pressure zone is established by a neighboring wellhead under a pumping operation.

18. The method of claim 15, wherein the wellhead is positioned on a drilling pad within fifteen feet of a second wellhead, and wherein decoupling the wireline system from the wellhead via the remotely actuated connector occurs during a fracturing operation at the second wellhead.

* * * * *